US005097967A

United States Patent [19]

Sica

[11] Patent Number: 5,097,967

[45] Date of Patent: Mar. 24, 1992

[54] PAINT BRUSH CLEANING, DRYING, AND STORAGE CONTAINER

[76] Inventor: Anthony A. Sica, 724 Fulton St., Philadelphia, Pa. 19147

[21] Appl. No.: 579,240

[22] Filed: Sep. 4, 1990

Related U.S. Application Data

[63] Continuation-in-part of Ser. No. 350,543, May 11, 1989, abandoned.

[51] Int. Cl.[5] ..... A47B 81/02

[52] U.S. Cl. ..... 211/66; 206/362; 312/206

[58] Field of Search ..... 15/38, 257 R, 264; 248/110; 211/65, 66, 70.6; 206/15.2, 362; 312/206, 207

[56] References Cited

U.S. PATENT DOCUMENTS

| | | | |
|---|---|---|---|
| 1,979,241 | 11/1934 | Albanese et al. | 206/362 |
| 2,043,643 | 6/1936 | Yenne | 206/362 |
| 2,278,650 | 4/1942 | Drinkwater | 211/65 |
| 2,310,533 | 2/1943 | Lindell | 211/65 |
| 2,472,001 | 5/1949 | Buhoveckey | 206/209 |
| 2,479,509 | 8/1949 | Pichniarczyk | 206/362 |
| 2,584,219 | 2/1952 | Murrell | 211/65 |
| 2,952,364 | 9/1960 | Jacobson | 211/65 |

FOREIGN PATENT DOCUMENTS

| | | | |
|---|---|---|---|
| 2069829 | 9/1981 | United Kingdom | 206/362 |

*Primary Examiner*—Edward L. Roberts

[57] ABSTRACT

A paint brush maintenance device used for soak-cleaning, washing, drip-drying, and storing paint brushes. This device comprises a brush hanger bar (10) having adjustable hooks (16) that permit the raising and lowering of paint brushes independent of one another in a suspended position, whereby, the drip-drying of paint brushes can be accomplished while other paint brushes are soak-cleaning at the same time. The adjustable hooks also permit paint brushes of various lengths to be individually adjusted so that only the brush bristles are immersed during the soak-cleaning process. During painting operations the brush hanger bar holds brushes over the container (20) that are wet with paint and which are temporarily not in use in order to protect floors and carpeting from accidental paint brush drippings. The container collects paint brush drippings during the drip-drying process and is used to soak-clean, wash, and store paint brushes. A lid (22) is provided to cover the container to keep stored paint brushes free from dust and dirt.

15 Claims, 1 Drawing Sheet

PAINT BRUSH CLEANING, DRYING, AND STORAGE CONTAINER

This is a continuation-in-part of Ser. No. 07/350,543 filed 1989 May 11, now abandoned.

BACKGROUND-FIELD OF INVENTION

This invention relates to paint brush maintenance devices.

BACKGROUND-DESCRIPTION OF PRIOR ART

The applicant has no knowledge of any prior art except for the three cited references discussed below.

None of the three cited references have the means for permitting the raising and lowering of paint brushes independent of one another.

The prior art reference cited, for example, in the H. R. Lindell patent 2,310,533 (1943) shows a paint brush rack that is designed to raise or lower all of the rack held paint brushes simultaneously, therefore, the user can not accomplish both the drip-drying of paint brushes while other paint brushes are soak-cleaning at the same time. The user would have to wait for the completion of one operation before starting another, which is very inconvenient and time consuming. Therefore, most users would prefer a device that would allow for both operations to be performed at the same time.

Lindell's patent also requires a lot of specially designed parts, and many moving parts that require precise alignment to one another, thereby, making it more complex and more intricate than necessary, therefore, more costly to manufacture, thus, more costly to the consumer. In addition, Lindell's patent is troublesome and time consuming for the user to set up due to requiring tedious alignments and connections.

In C. M. Drinkwater U.S. Pat. No. 2,278,650 (1942) the first claim recites a specific feature which is a set of spring clips. These spring clips require the use of two free hands in order to hang a brush which at times is very inconvenient. In the H. M. Albanese et. al. U.S. Pat. No. 1,979,241 (1934), when paint brushes are soak-cleaning other paint brushes which are drying are not held suspended in order to drip-dry, they lie in their drippings. The C. M. Drinkwater patent and the H. M. Albanese et. al. patent both are not designed to have the paint brush bristles exposed for visibility when in the suspended position. It is essential that the paint brush bristles are exposed when hung in the suspended position in order to allow for faster drying during the drip-drying process and to visually view the entire brush in order to distinguish the paint brush sizes and their condition without the disadvantage of having to remove them from the container. It is also essential during painting operations that the paint brush bristles are exposed when in the hung position to visually view and observe the physical state of brushes that are wet with paint, so as to make sure the paint is not drying on the bristles and to easily distinguish, at a glance, paint brush sizes and paint colors used on each brush. Therefore, the C. M. Drinkwater and H. M. Albanese et. al. patented devices are not effective during the drip-drying and painting operations. In addition, the Drinkwater and the Albanese patents have too many parts, and complex fabrication, which also makes them much more complex than necessary, therefore, more costly to manufacture.

Objects and Advantages

Accordingly, several objects and advantages of my invention are:

(a) to provide a device that will provide an organized place to properly drip-dry paint brushes (after washing) in a suspended position in order to properly maintain their bristle shape while it conveniently collects the paint brush drippings which may contain solvent or water and paint residue.

(b) to provide a device that can be used to accomplish both the soak-cleaning of paint brushes while other paint brushes are drip-drying at the same time and in a suspended position in order to hold them away from their drippings, and to prevent distortion of the paint brush bristles.

(c) to provide a device that will soak-clean paint brush bristles in a suspended position while holding the handle and ferrule of various length brushes just above the water or other cleaning liquid. This is made possible by the independently adjustable hooks.

(d) to provide a device that is useful during painting operations; when brushes are wet with paint and are temporarily not in use, they can be hung on the brush hanger bar in order to protect floors and carpeting from accidental paint brush drippings. Generally, professional painters, and do-it-yourself painters, while painting, temporarily lay their paint brushes on an open paint can, getting unwanted paint on the brush handle and ferrule, consequently on the painters hands. This device avoids this problem.

(e) to provide a device in which paint brushes can be stored free from dust dirt.

(f) to provide a device for the complete maintenance of paint brushes which is simple in design and comprises very few basic parts.

(g) to provide a device for the complete maintenance of paint brushes which is simple to use and inexpensive to manufacture.

Still further objects and advantages of my invention will become apparent from a consideration of the ensuing description and the accompanying drawing.

DRAWING DESCRIPTION

REFERENCE NUMBERS IN DRAWING

Figure 1:
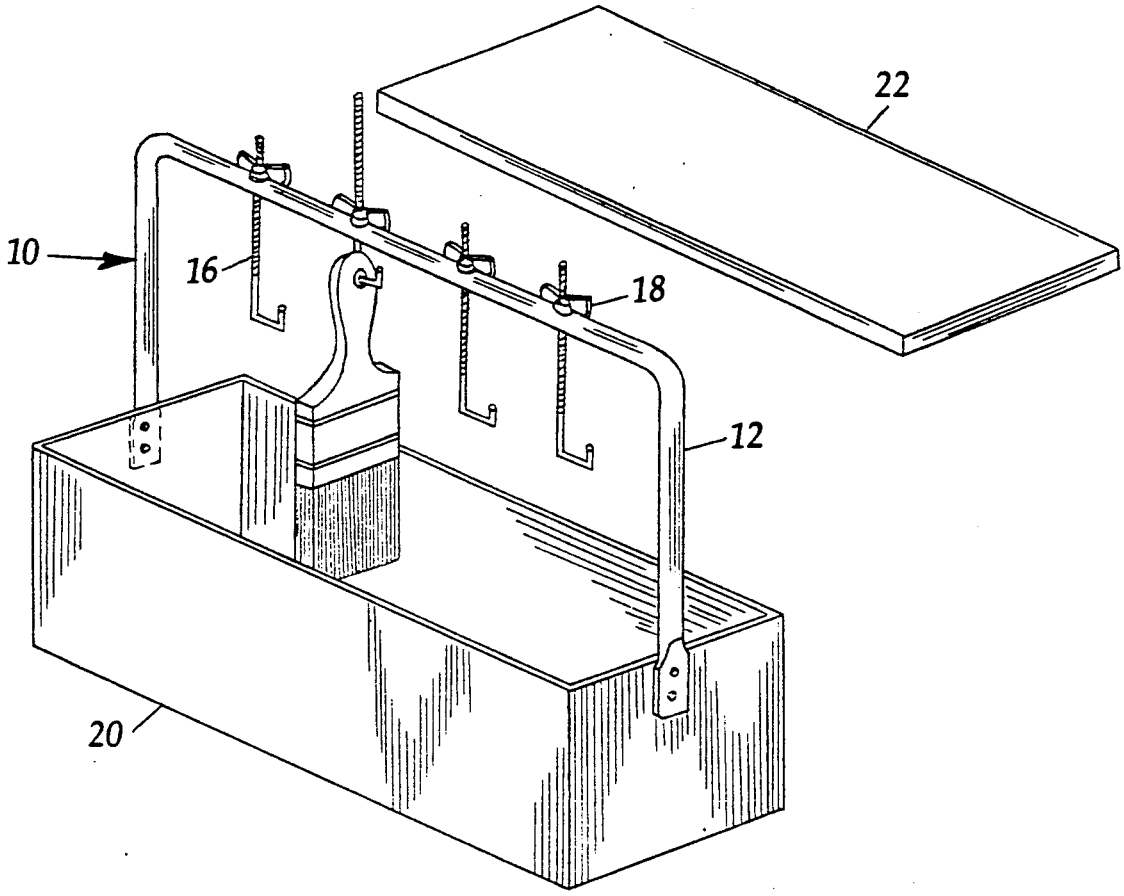
FIG. 1 is a perspective view of the invention.

10 brush hanger bar
20 container
12 U-shaped bar
22 lid
14 through-holes
24 bolts
16 adjustable hooks
26 cap nuts
18 wing nuts
28 spacers

DESCRIPTION OF INVENTION

Figure 2:
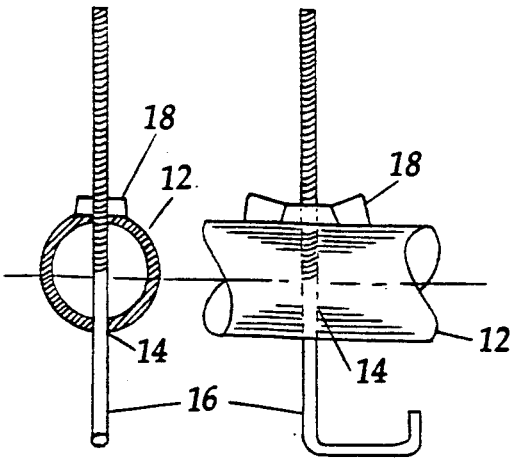
FIG. 2 is an exploded view of the U-shaped bar and hook connection.
Figure 3:
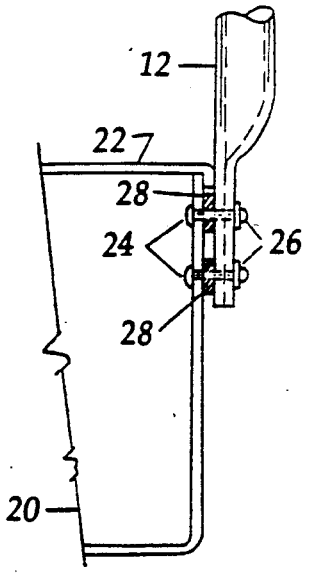
FIG. 3 is an exploded view of the U-shaped bar to container connection.

FIG. 1 shows a perspective view according to the preferred embodiment of the invention. The invention comprises a hollow U-shaped bar 12 with through-holes 14 to accommodate the adjustable hooks 16. Wing nuts 18 screw on to the hooks 16 having threaded shanks and retain the hooks 16 in the desired height position on the U-bar 12 shown in FIG. 1 and FIG. 2. FIG. 3 shows the U-shaped bar 12 connection to the container 20 by bolts 24 and cap nuts 26. Spacers 28 are placed between the U-bar 12 and the container 20 to leave clearance to allow for proper fit of the lid 22.

This device can be made out of materials such as metal, plastic or vinyl. It also can be made in different colors.

OPERATION OF INVENTION

The paint brush maintenance device shown in FIG. 1 can be used to drip-dry, soak-clean, wash, and store paint brushes.

To drip-dry paint brushes after washing, hang them on the hooks 16. The paint brush drippings are collected into the container 20.

To soak-clean paint brushes, hang them on the adjustable hooks 16 and lower the brushes by turning the wing nuts 18 that are screwed on to the hooks 16 so that only the brush bristle are immersed in water or other cleaning liquid in the container 20.

The adjustable hooks 16 permit paint brushes of various lengths to be individually adjusted so that only the brush bristles are immersed in water or other cleaning liquid.

The adjustable hooks 16 also permits the raising and lowering of paint brushes independent of one another, thereby, the user can accomplish both the drip-drying of paint brushes while other paint brushes are soak-cleaning at the same time. This capability allows brushes wet with paint requiring immediate cleaning to be soak-cleaned without interfering with paint brushes that are drip-drying, and vice versa. Brushes that require less soak-cleaning time can be raised independently (above the cleaning liquid level) to drip-dry without disturbing brushes that require more time to soak-clean.

Paint brushes can be washed in the container 20 and hung on the brush hanger bar 10 to drip-dry.

During painting operations; when brushes are wet with paint and are temporarily not in use, they can be hung on the brush hanger bar 10 in order to protect floors and carpeting from accidental paint brush drippings. The paint brush drippings are collected into the container 20.

The container 20 is also used to store paint brushes. The lid 22 is used to cover the container 20 to keep the stored paint brushes free from dust and dirt.

SUMMARY, RAMIFICATIONS, AND SCOPE

Accordingly, the reader will see that the paint brush maintenance device of the invention is a very handy, convenient, helpful, and invaluable, yet an economical device to be used by anyone in the process of painting.

This paint brush maintenance device will be used for soak-cleaning, washing, drip-drying, and the storing of paint brushes. Furthermore, this device has the additional advantages in that it permits the raising and the lowering of paint brushes independent of one another in a suspended position, whereby, both the soak-cleaning of paint brushes can be accomplished while other paint brushes are drip-drying in a suspended position at the same time; it saves time by avoiding having to wait for completion of one operation before starting another; it allows brushes that are wet with paint requiring immediate cleaning to be soak-cleaned without interfering with brushes that are drip-drying, and vice versa; it permits brushes requiring less soak-cleaning time to be raised independently (above the cleaning liquid level) to drip-dry without disturbing brushes that require more time to soak-clean.

it provides a device that will provide an organized place to properly drip-dry paint brushes (after washing) in a suspended position in order to properly maintain their bristle shape while it conveniently collects the paint brush drippings which may contain solvent or water and paint residue.

it provides a device that can be used to accomplish both the soak-cleaning of paint brushes while other paint brushes are drip-drying at the same time and in a suspended position in order to hold them away from their drippings, and to prevent distortion of the paint brush bristles.

it provides a device that will soak-clean paint brush bristles in a suspended position while holding the handle and ferrule of various length brushes just above the water or other cleaning liquid. This is made possible by the independently adjustable hooks.

it provides a device that is useful during painting operations; when brushes are wet with paint and are temporarily not in use, they can be hung on the brush hanger bar over the container to protect floors and carpeting from accidental paint brush drippings. Generally, professional painters and do-it-yourself painters, while painting, temporarily lay their paint brushes on an open paint can, getting unwanted paint on the brush handle and ferrule, consequently on the painter's hands. This device avoids this problem.

it provides a device in which paint brushes can be stored free from dust and dirt.

it provides a device for the complete maintenance of paint brushes that is simple in design and comprises very few basic parts.

it provides a device for the complete maintenance of paint brushes which is simple to use and inexpensive to manufacture.

While my above description contains many specificities, these should not be construed as limitations on the scope of the invention, but as merely providing an exemplification of one preferred embodiment thereof. Many other variations are possible. For example the adjustable hooks or the like can be made to screw through or on the U-bar or the like, thereby, omitting the wing nuts. The hooks can also be designed to slide through or on the U-bar, thereby, also omitting the wing nuts. The U-bar to container connection can be made in different ways such as a slide-in connection, a snap-on connection, etc., thereby, omitting the connection hardware.

This device can be designed to take alternate physical forms and dimensions, and should not be limited to any form shown. Accordingly, the scope of the invention should be determined not by the embodiment illustrated but by the appended claims and their legal equivalents.

I claim:

1. A paint brush maintenance device comprising a member extending over a receptacle and attaching to said receptacle, paint brush holding elements are attached at spaced locations along said member and means for raising and lowering each said element independent of one another on said member, whereby paint brushes can be soak-cleaning in a suspended position while other paint brushes are drip-drying in a suspended position at the same time.

2. The paint brush maintenance device of claim 1 wherein said means comprises a fastener attached to each said element for securing each said element in selective variable vertical positions on said member, whereby various length paint brushes can be simply and accurately immersed individually to the desired depth in said receptacle.

3. The paint brush maintenance device of claim 2 wherein each said fastener is a wing nut with female threads and each said element has male threads, a vertical hole through said member is provided for each said element, each said element is inserted up and through each said hole in said member and is threadedly mated with the female threads of each said wing nut on top of said member to secure each said element in the selected vertical position on said member.

4. The paint brush maintenance device of claim 1 wherein said member is U-shaped, said member extends over said receptacle and attaches at each end to opposite sides of said receptacle, said elements are attached at spaced locations along the center section of said member.

5. The paint brush maintenance device of claim 1 further includes a lid which covers the open end of said receptacle, whereby paint brushes stored in said receptacle can be kept free from dust and dirt.

6. A paint brush maintenance device comprising one or more paint brush holding elements along a member and means for raising and lowering each said element independent of one another on said member, said member extends over a receptacle and attaches to said receptacle.

7. The paint brush maintenance device of claim 6 wherein said means comprises a fastener attached to each said element for securing each said element in selective variable vertical positions on said member, whereby various length paint brushes can be simply and accurately immersed individually to the desired depth in said receptacle.

8. The paint brush maintenance device of claim 7 wherein each said fastener is a wing nut with female threads and each said element has male threads, a vertical hole through said member is provided for each said element, each said element is inserted up and through each said hole in said member and is threadedly mated with the female threads of each said wing nut on top of said member to secure each said element in the selected vertical position on said member.

9. The paint brush maintenance device of claim 8 wherein said member is U-shaped, said member extends over said receptacle and attaches at each end to opposite sides of said receptacle, said elements are attached along the center section of said member.

10. The paint brush maintenance device of claim 8 further includes a lid which covers the open end of said receptacle, whereby paint brushes stored in said receptacle can be kept free from dust and dirt.

11. A paint brush maintenance device comprising a bar extending over a container and attaching to said container, hooks for holding paint brushes are attached at spaced locations along said bar and means for raising and lowering said hooks independent of one another on said bar, whereby paint brushes can be soak-cleaning in a suspended position while other paint brushes are drip-drying in a suspended position at the same time.

12. The paint brush maintenance device of claim 11 wherein said means comprises a fastener attached to each said hook for securing each said hook in selective variable vertical positions on said bar, whereby various length paint brushes can be simply and accurately immersed individually to the desired depth in said container.

13. The paint brush maintenance device of claim 12 wherein each said fastener is a wing nut with female threads and each said hook has male threads, a vertical hole through said bar is provided for each said hook, each said hook is inserted up and through each said hole in said bar and is threadedly mated with the female threads of each said wing nut on top of said bar to secure each said hook in the selected vertical position on said bar.

14. The paint brush maintenance device of claim 11 wherein said bar is U-shaped, said bar extends over said container and attaches at each end to opposite sides of said container, said hooks are attached at spaced locations along the center section of said bar.

15. The paint brush maintenance device of claim 11 further includes a lid which covers the open end of said container, whereby paint brushes stored in said container can be kept free from dust and dirt.

* * * * *

UNITED STATES PATENT AND TRADEMARK OFFICE

CERTIFICATE OF CORRECTION

PATENT NO. : 5,097,967

DATED : March 24, 1992

INVENTOR(S) : Anthony A. Sica

It is certified that error appears in the above-identified patent and that said Letters Patent is hereby corrected as shown below:

Col. 5, line 28, after "elements" insert --attached--.

Col. 6, line 3, change "8" to --6--.

Col. 6, line 8, change "8" to --6--.

Signed and Sealed this

First Day of June, 1993

Michael K. Kirk

*Attest:*

MICHAEL K. KIRK

*Attesting Officer*

*Acting Commissioner of Patents and Trademarks*